US006361437B1

(12) United States Patent
Walker et al.

(10) Patent No.: US 6,361,437 B1
(45) **Date of Patent: *Mar. 26, 2002**

(54) REMOTE GAMING DEVICE

(75) Inventors: Jay S. Walker, Ridgefield; James A. Jorasch, Stamford; Thomas M. Sparico, Riverside, all of CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/401,205

(22) Filed: Sep. 22, 1999

Related U.S. Application Data

(63) Continuation of application No. 08/775,577, filed on Dec. 31, 1996, now Pat. No. 6,001,016.

(51) Int. Cl.[7] ..... A63F 9/24
(52) U.S. Cl. ..... 463/23
(58) Field of Search ..... 463/1, 12–13, 463/16, 20, 25, 29, 30, 36, 40–42; 273/143 R, 292–293, 138.1, 138.2, 139; 700/91–93

(56) References Cited

U.S. PATENT DOCUMENTS

| | | | | |
|---|---|---|---|---|
| 4,467,424 A | | 8/1984 | Hedges et al. | |
| 5,259,613 A | | 11/1993 | Marnell, II | |
| 5,390,934 A | | 2/1995 | Grassa | |
| 5,392,934 A | | 2/1995 | Fox | |
| 5,395,242 A | | 3/1995 | Slye et al. | |
| 5,397,128 A | | 3/1995 | Hesse et al. | |
| 5,411,258 A | | 5/1995 | Wilson et al. | |
| 5,570,885 A | | 11/1996 | Ornstein | |
| 5,630,586 A | * | 5/1997 | Lowden | 463/202 |
| 5,770,533 A | | 6/1998 | Franchi | |
| 6,001,016 A | * | 12/1999 | Walker | 463/202 |

* cited by examiner

*Primary Examiner*—Mark Sager
(74) *Attorney, Agent, or Firm*—Dean P. Alderucci

(57) ABSTRACT

A method and system for remote play of a gaming device, such as a slot machine. A player enters play preferences at a remote wagering terminal. The remote wagering terminal transmits the play preferences to a slot network server that stores the play preferences. Based upon the play preferences, the slot network server identifies one or more slot machines and transmits outcome data from those slot machines to the remote wagering terminal. The outcome data may be live or historical. In one embodiment of the present invention, the slot network service generates simulated outcome data to the remote wagering terminal. The slot network server keeps track of the player's wins and losses based upon the outcome data.

3 Claims, 13 Drawing Sheets

448

| REMOTE WAGERING TERMINAL ID 4480 | TERMINAL LOCATION 4481 | PLAYER ID NUMBER 4482 | START TIME OF REMOTE PLAY 4483 | END TIME OF REMOTE PLAY 4484 | SLOT MACHINE TYPE 4485 |
|---|---|---|---|---|---|
| | | | | | |
| | | | | | |
| | | | | | |

FIG. 6

REMOTE GAMING DEVICE

CROSS-REFERENCE TO RELATED APPLICATION

This is a continuation of prior application Ser. No. 08/775,577, filed Dec. 31, 1996, now U.S. Pat. No. 6,001,016.

BACKGROUND OF THE INVENTION

1. Field of the Invention

The present invention relates generally to a method and apparatus for operation of a gaming device, such as a slot machine and, more particularly, for remote play of such gaming devices.

2. Description of the Related Art

There are numerous types of gaming devices in use today. Many of these gaming devices, such as slot machines, video blackjack machines, video poker machines, video roulette machines, and the like, typically allow only one player to operate a given machine at a time. Thus, only that one player can wager and collect payouts. Furthermore, that one player typically must be physically present at the gaming device. Thus, the typical gaming device has drawbacks for both the gaming device players and owners.

Because the player must be physically present at the gaming device, the player is limited in the number and type of games that can be played. Slot machine players, for example, are known to play multiple machines at one time by inserting money in several adjacent slot machines and then pressing the play button of each machine in rapid succession. Such a manner of playing the machines can be awkward as the player must move from machine to machine in order to feed money and initiate each play on each machine. Furthermore, because slot machines of the same type are typically placed next to each other in a casino, a player cannot play different types of machines at the same time. Thus, there is a need for a method and system for remote play of gaming devices, particularly of different type devices.

Keno permits a player to play without an actual physical presence at a machine. In Keno, a player selects a series of numbers. A game consists of matching the players numbers against a series of numbers drawn by the casino. Once the player has selected the series of numbers, the player selects a certain number of games for which those numbers are valid. Thus, by selecting several games, the player may bet on future games without a continued presence at a machine.

With Keno, however, there is no remote play. The numbers are automatically and continuously drawn by a central server and broadcast or transmitted to a number of screens throughout an establishment, such as a casino. While an unlimited number of players can attempt to match the numbers drawn, players do not initiate play. Additionally, only one type of game is being played at a time. Thus, Keno cannot be said to provide remote play of a gaming machine, particularly of the type in which each play is initiated by a player.

Blackjack and Pai Gow poker tables sometimes allow a non-player to make wagers on top of those made by the participants of the games. In other words, while one player sits at a table, non-players may stand behind the player and wager on the player's hand. While allowing more than one person to wager on a game, these practices require all persons wagering to be physically present at the table. No remote wagering or play occurs.

Betting by non-participants on top of a player's wager has several disadvantages. For example, additional surveillance is required by casino personnel because disputes may arise as to which person has made a particular wager. Disputes as to which person has the right to decide how to play the hand also arise. Consequently, a need exists for remote wagering and play of gaming devices.

Multiplayer gaming devices exist which permit multiple players to play a single gaming device. For example, "Sigma Derby" is a game in which multiple players simultaneously wager on a simulated horse race. Each player bets individually, in a separate coin acceptor. Despite allowing several players to participate in the game, Sigma Derby also requires each of the players to be physically present. Therefore, such multiplayer gaming devices fail to fulfill the need for a method and system for remote wagering and play of a gaming device.

U.S. Pat. No. 4,467,424 to Hedges et al. (Hedges) is directed to a gaming system in which a remote player watches a live video of a game and participates in the playing of that game. Specifically, a video camera located at a gaming table, such as craps table, which is run by a casino employee called a croupier, sends a live video signal to a remote player at a player station. At the player station, the remote player watches the actual play and wagers along with the players at the table. The player enters the wager into the player station, which, in turn, transmits the wager to a credit station. In this system, however, the croupier manually enters the outcome of each game played at the table into a croupier station. The outcome is communicated to the credit station. The credit station then communicates the outcome to the remote player at the player station. The credit station stores the player's credit balance and updates the credit balance based upon the player's wager and the outcome of each game.

The remote gaming system of Hedges, however, has several disadvantages. Hedges requires that a live video signal be sent from the croupier station to the player station. Such a system can be costly and difficult to maintain, particularly if multiple croupier stations exist. Moreover, reliance on the live video signal causes the Hedges device to be error-prone because the camera view may be temporarily blocked or the video system may fail. The player must actually participate in the game. Specifically, the remote player actually participates in and makes decisions regarding play by watching the live video display. Thus, the remote player is limited to remotely playing one game at a time and is, therefore, limited in the frequency of wagering opportunities. The results of play at the table are not automatically transferred to the remote player. Instead, the croupier must manually input the results at the croupier station. The manual intervention allows for fraudulent or erroneous results to be passed to the credit station and the remote player. Furthermore, only if the live video signal is recorded or archived could an allegation of an erroneous result be confirmed.

In sum, there exists a need for a method and system for remote wagering and play of a gaming device, particularly a method and system that does not require human intervention and live video transmission of the game being played.

SUMMARY OF THE INVENTION

Thus, a method according to one embodiment of the present invention satisfies this need by providing a gaming system which includes a server, a plurality of gaming devices, and a remote wagering terminal. Each of the gaming devices is configured to generate outcome data and automatically communicate the outcome data to the server.

Furthermore, the server is configured to select outcome data from at least one of the gaming devices for receipt by the remote wagering terminal.

The present invention also includes a method including the steps of receiving a play preference, generating by a gaming device outcome data, automatically communicating the outcome data from the gaming device to a server, selecting outcome data based upon the play preference, and communicating the selected outcome data to a remote wagering terminal. In an alternative embodiment of the present invention, the method includes simulating an outcome of the gaming device based upon the outcome data.

A method according to another embodiment of the present invention includes the steps of automatically receiving outcome data from a gaming device, wherein the gaming device is of a type wherein a paid play initiates a random event that results in the outcome data, selecting outcome data, and communicating the outcome data to a remote wagering terminal.

According to another embodiment, the method includes the steps of receiving outcome data, and generating simulated play based upon the outcome data.

BRIEF DESCRIPTION OF THE DRAWINGS

FIG. 6 is a schematic view of the remote wagering terminal database of the slot network server of FIGS. 1 and 3;

DETAILED DESCRIPTION OF PREFERRED EMBODIMENTS

The present invention is directed generally to a method and system for remote play of a gaming device, such as a slot machine. A player enters play preferences at a remote wagering terminal. The remote wagering terminal transmits the play preferences to a slot network server that stores the play preferences. Based upon the play preferences, the slot network server identifies the outcome data from one or more slot machines and transmits this outcome data from those slot machines to the remote wagering terminal. One embodiment utilizes live outcome data while another embodiment utilizes stored, historical outcome data from previous plays of a slot machine. In an alternate embodiment of the present invention, the slot network server generates simulated outcome data for display by the remote wagering terminal. The slot network server keeps track of the player's wins and losses based upon the outcome data.

Certain preferred embodiments of the present invention will now be described in greater detail with reference to the drawings. Although the embodiments discussed herein are directed to slot machines, it is to be understood that the present invention is equally applicable to other gaming devices, such as video poker machines, video blackjack machines, video roulette machines, video keno machines, video bingo machines, and the like.

Figure 1:
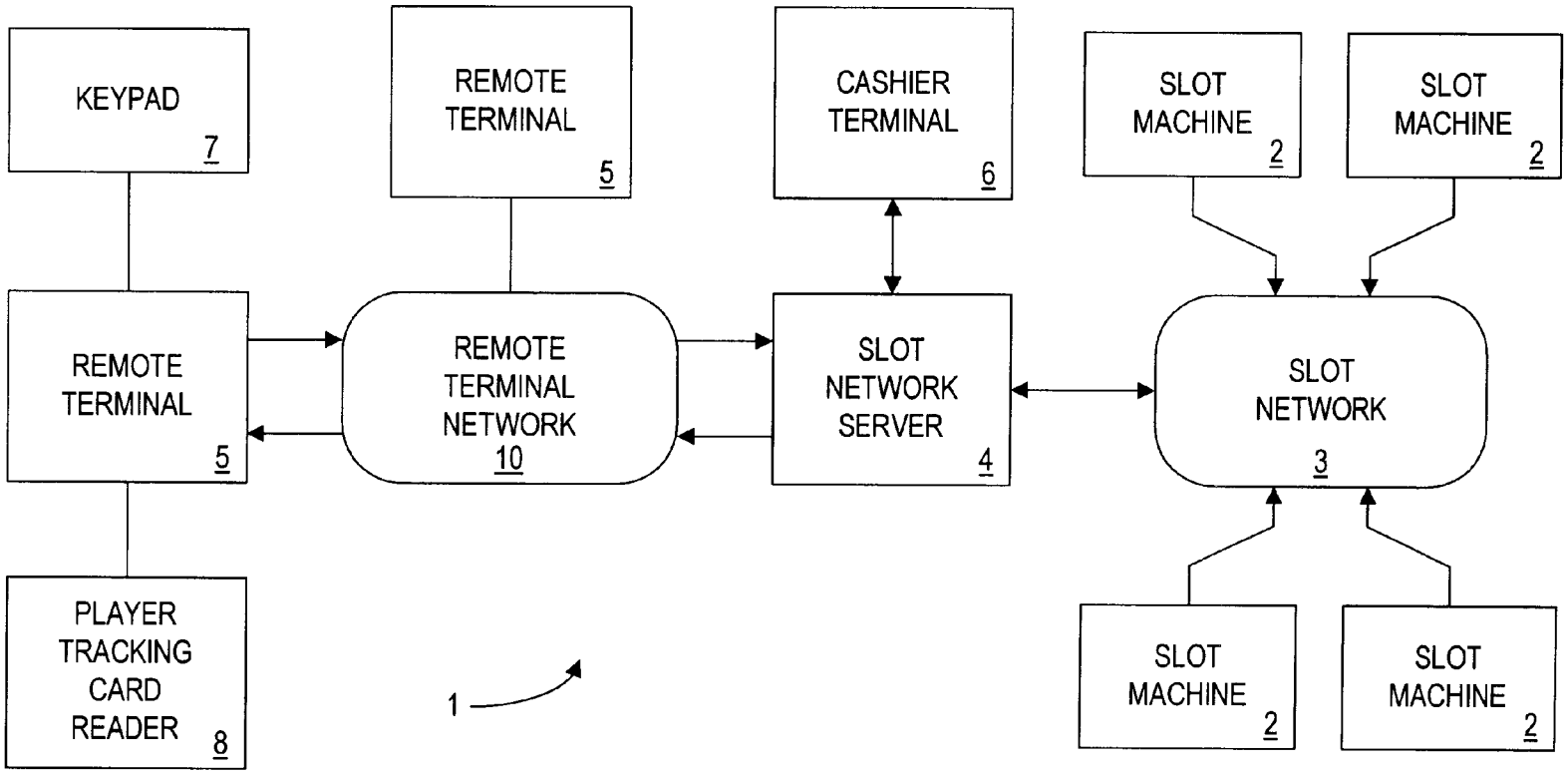
FIG. 1 is a schematic view of a system according to one embodiment of present invention.

With reference to FIG. 1, a system 1 is shown. In general, the system 1 includes multiple slot machines 2 in communication with a slot network server 4 via a conventional local area network (slot network) 3. The slot network 3 is controlled by the server 4. It is to be understood that communication between each slot machine 2 and the server 4 may also occur across a wireless network or internet connection. The remote wagering terminals 5 also communicate with the slot network server 4 being coupled to the slot network server 4 via a remote wagering terminal network 10. The remote wagering terminal network 10 is a conventional local area network that is controlled by the server 4. Each remote wagering terminal 5 includes a keypad 7 and a player tracking card reader 8. A cashier terminal 6 is coupled to the server 4.

As will be discussed in greater detail below, each slot machine 2 communicates outcome data to the slot network server 4. As used herein, outcome data includes all information capable of being passed from a slot machine 2 to the slot network server 4. Such outcome data includes whether the player has won or lost, the amount of the payout (if any), the amount lost (if any), and, in the preferred embodiment, the outcome of a play of the slot machine 2, namely the position of the reels on the slot machine 2.

In an embodiment in which the gaming device is a video poker machine, a video blackjack machine, or another gaming device for which play is based upon playing cards, the outcome is the card values. Similarly, in an embodiment in which the gaming device is a video roulette machine, the outcome is the final number and color.

Outcome data is further defined as live or historical. Live outcome data is outcome data not previously received by the slot network server 4. Thus, live outcome data typically represents the most recent play of a given gaming device. Historical outcome data, on the other hand, is outcome data previously received from a gaming device and stored. Thus, historical outcome data typically represents plays, other than the most recent, of a gaming device.

Because each slot machine 2 has a unique machine identification (ID) number, the slot network server 4 is able to distinguish the outcome data as being sent from a particular slot machine 2 and to store the outcome data with reference to that particular machine 2.

Communication between the remote wagering terminal 5 and slot network server 4 is initiated when a player inserts a player tracking card into the player tracking card reader 8. Typically, a casino issues a player tracking card containing player identifying information. Such identifying information can be any information that uniquely identifies a player to the system 1 and, in the present embodiment, includes the player identification (ID) number. The identifying information is preferably stored on a magnetic strip on the player tracking card.

The player tracking card reader 8 reads the player identifying information from the player tracking card and transmits the information to the slot network server 4. Because the player identifying information uniquely identifies a given player, the slot network server 4 is able to access information associated with that player, such as a credit balance.

As discussed below, once a remote player has inserted the player tracking card 9 into the card reader 8, the remote player enters play preferences through a touch screen or, in the illustrated embodiment, an alphanumeric keypad 7 to initiate remote slot machine play. Play preferences include any information that defines which gaming device or devices are to be played and how they are to be played. Thus, play preferences include the number of devices to be accessed, bet per play, type of device, denomination of device, speed of play, machine ID number (if available), and the like. The slot network server 4 is able to identify the remote wagering terminal 5 source of the play preferences because each remote wagering terminal 5 has associated therewith a remote wagering terminal identification (ID) number that uniquely identifies the remote wagering terminal 5.

Figure 2:
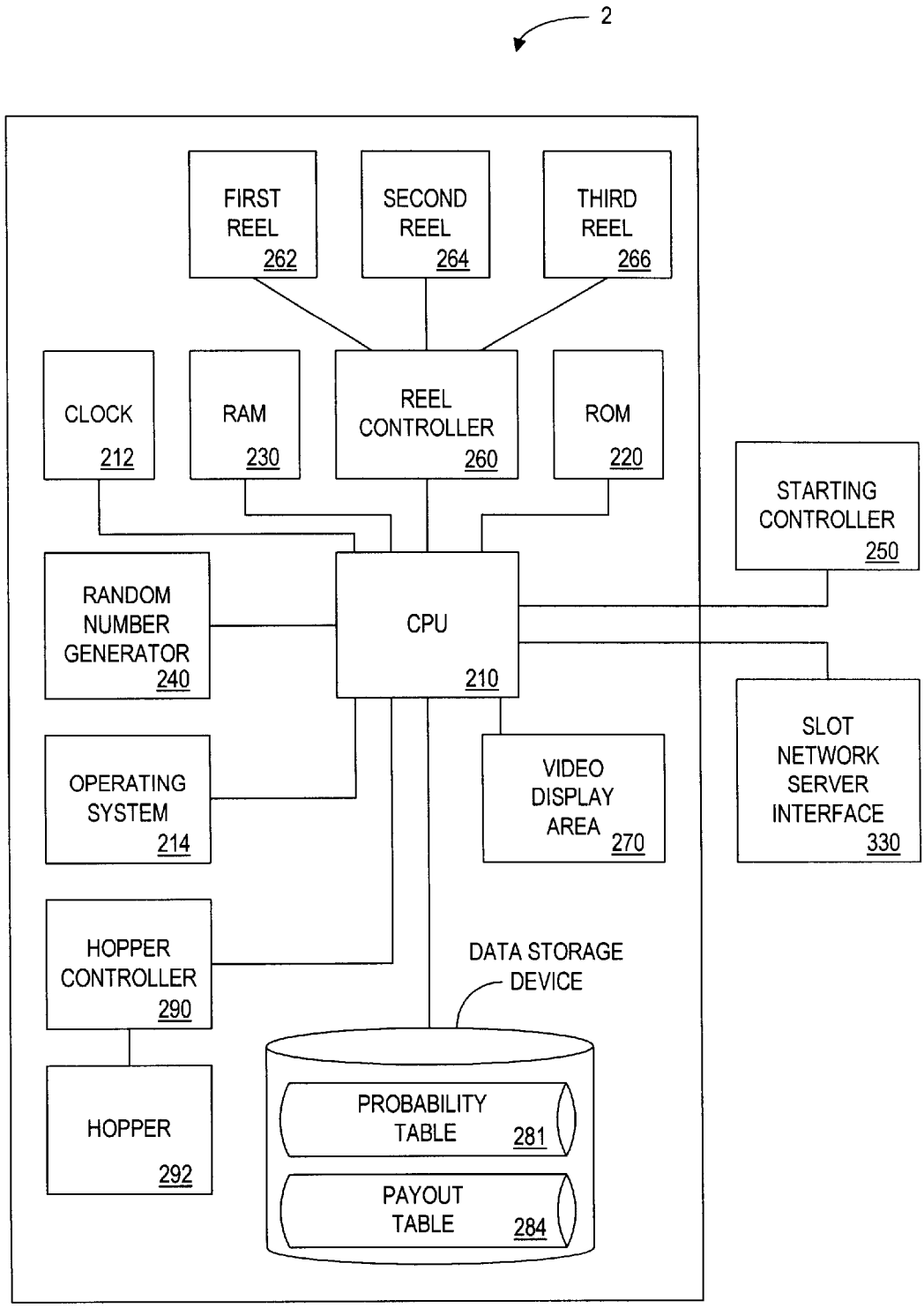
FIG. 2 is a schematic view of a slot machine of FIG. 1.

With reference to FIG. 2, the slot machine 2 will now be described in greater detail. Each slot machine 2 includes a Central Processing Unit (CPU) 210, a clock 212, and an operating system 214 stored in memory. The CPU 210 executes instructions of a program stored in Read Only Memory (ROM) 220 for playing the slot machine 2. The Random Access Memory (RAM) 230 temporarily stores information passed to it by the CPU 210. A Random Number Generator (RNG) 240 is also in communication with the CPU 210.

With respect to a play of the slot machine 2, slot machine 2 operates in a conventional manner. The player starts the machine by inserting a coin, or using electronic credit, and activating a starting controller 250. Under control of a program stored, for example, in a storage device 280 or the ROM 220, the CPU 210 initiates the RNG 240 to generate a random number; the CPU 210 looks up the generated random number in a stored probability table 281 and finds the corresponding outcome. Based on the identified outcome, the CPU locates the appropriate payout in a stored payout table 284. The CPU 210 also directs a reel controller 260 to spin reels 262, 264, 266 and to stop them at a point when they display a combination of symbols corresponding to the selected payout. When the player wins, the machine stores the credits in RAM 235 and displays them in video display area 270.

A hopper controller 290 is connected to a hopper 292 for dispensing coins. When the player requests to cash out by pushing a button on the slot machine 2, the CPU 210 checks the RAM 235 to see if the player has any credit and, if so, signals the hopper controller 290 to release an appropriate number of coins into a payout tray (not shown).

In alternative embodiments, the slot machine 2 does not include the reel controller 260 and reels 262, 264 266. Instead, a video display area 270 graphically displays representations of objects contained in the selected game, such as graphical reels or playing cards. These representations are preferably animated to display playing of the selected game.

Also connected to the CPU 210 is a slot network server interface 330. The network server interface 330 provides a communication path from the slot machine 2 to the slot network 3 and, therefore, to the slot network server 4. Thus, as discussed in greater detail below, outcome data can be exchanged between the slot machine 2 and the slot network server 4.

Figure 3:
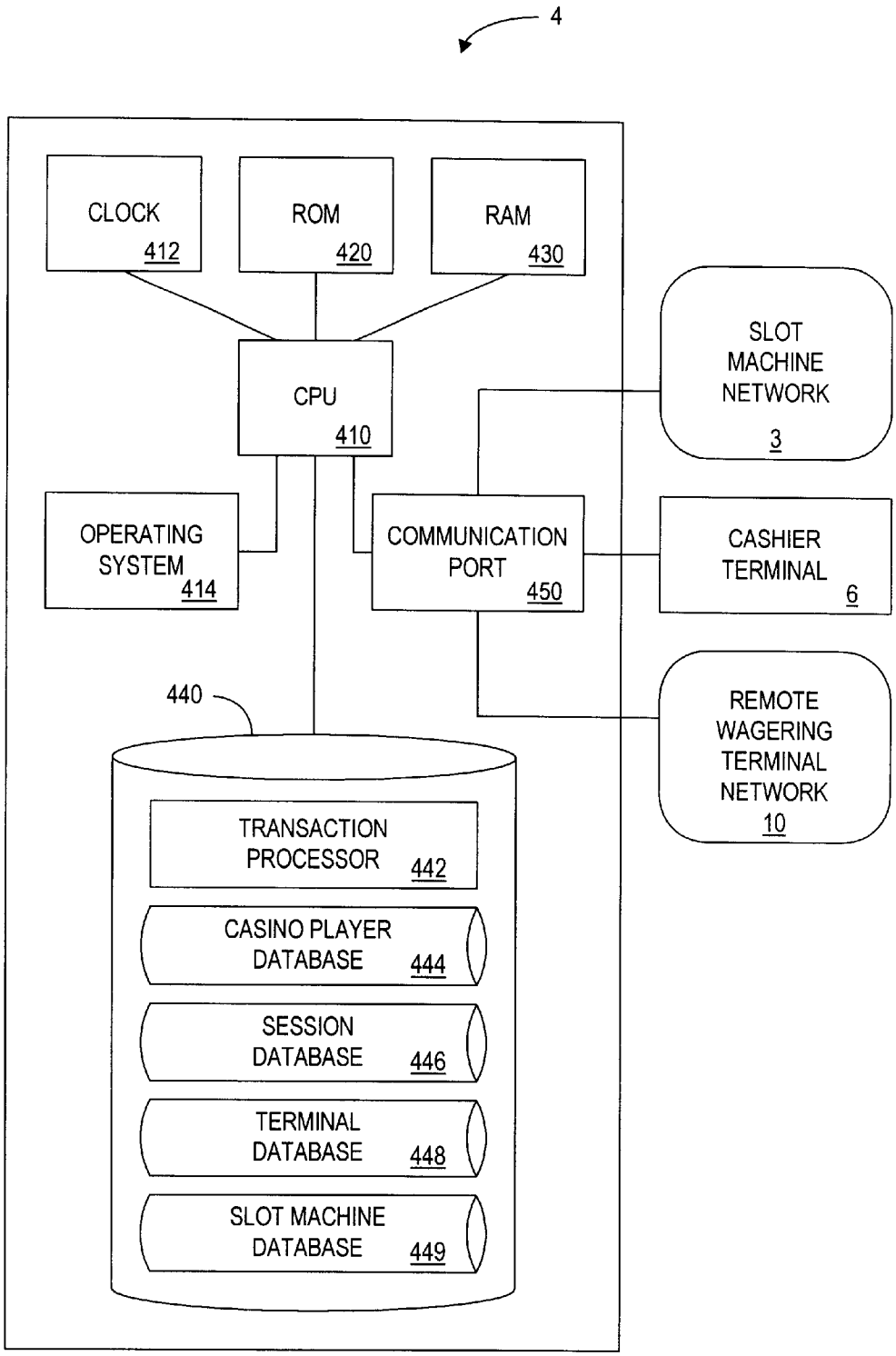
FIG. 3 is a schematic view of a slot network server of FIG. 1.

With reference to FIG. 3, the slot network server 4 will now be described in greater detail. Like the slot machine 2 of FIG. 2, the slot network server 4 has a Central Processing Unit (CPU) 410. The CPU 410, which has a clock 412 and operating system 414 associated therewith, executes instructions of a program stored in Read Only Memory (ROM) 420. During execution of the program instructions, the CPU 410 temporarily stores information in the Random Access Memory (RAM) 430.

In order to communicate with the remote wagering terminal 5, the slot network sever 4 also includes a communication port 450. The communication port 450 is coupled to the CPU 410, as well as to the slot machine network 3, remote wagering terminal network 10, and cashier terminal 6. Thus, the CPU 410 can control the communication port 450 to receive and transmit information from each slot machine 2, each remote wagering terminal 5, and the cashier terminal 6.

Additionally, the CPU 410 is coupled to a data storage device 440, having a transaction processor 442, a casino player database 444, a session database 446, a terminal database 448, and a slot machine database 449. In general, the transaction processor 442 manages the contents of the data storage device 440.

Figure 4:
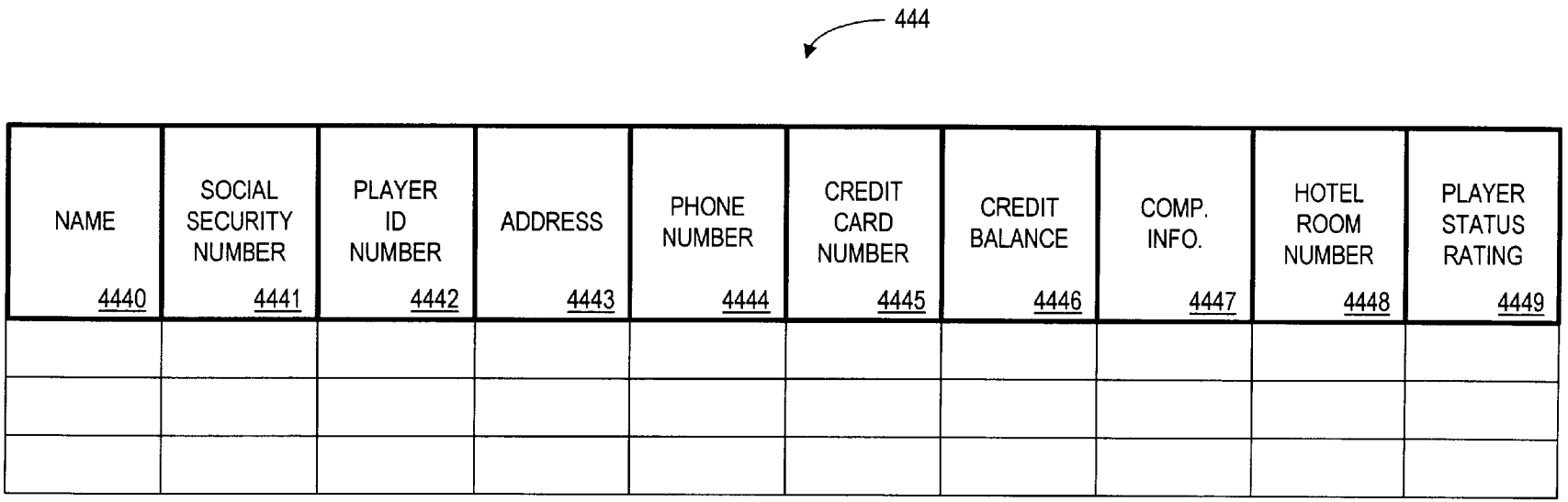
FIG. 4 is a schematic view of the player database of the slot network server of FIGS. 1 and 3.

In general, the casino player database 444 of the present embodiment, as shown in FIG. 4, includes multiple records having multiple fields of information related to player identification. Specifically, the player database 444 comprises multiple records, each record being associated with a particular player, as identified by a player identification (ID) number. The fields within each record include: name 4440, social security number 4441, player ID number 4442, player address 4443, telephone number 4444, credit card number 4445, credit balance 4446, complimentary information 4447, such as complimentary points awarded, hotel room number 4448, and player status rating 4449. Thus, having information related to one field, such as player ID 4442, allows the slot network server 4 to retrieve all information stored in the other fields of that player's record.

It is to be understood that for purposes of the present embodiment, only the player ID number field 4442, and the credit balance field 4446 are necessary. The remaining fields are merely representative of additional information that may be stored and used for other purposes. For example, credit card number 4445 and hotel room number 4448 are used for billing purposes and social security number 4441 is used to generate tax forms when a player wins a jackpot over a given amount.

Figure 5:
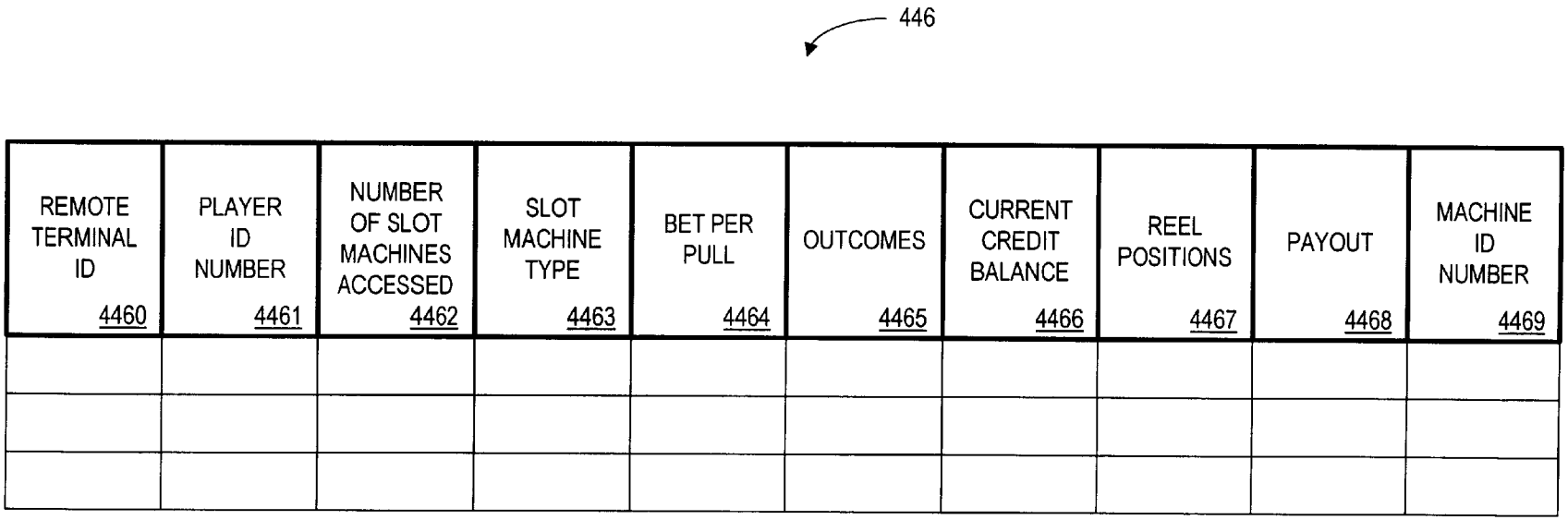
FIG. 5 is a schematic view of the session database of the slot network server of FIGS. 1 and 3.

The session database 446, as shown in FIG. 5, comprises multiple records, each record pertaining to the remote play session of a particular player, as identified by a remote wagering terminal ID number. Consequently, one field in each record is the remote wagering terminal ID field 4460. Other fields include: player ID 4461, number of slot machines to be accessed 4462, slot machine type 4463, bet per pull 4464, machine denomination 4465, credit balance 4466, reel position 4467, payout 4468, and machine ID number 4469. Because both the player database 444 and the session database 446 include a player ID field (4442 and 4461, respectively), the system 1 can correlate any information stored in the player database 444, corresponding to a particular player, with any information stored in the session database 446, corresponding to that same player.

As described below, a player may choose multiple slot machines 2 for remote play. The number of machines 2 chosen is stored in the "number of slot machines to be accessed" field 4462. For each slot machine 2 accessed, the session database includes information fields such as a machine ID number field and a machine type field for each slot machine 2 being accessed.

For simplification of the following description, reference is made to the fields in the session database 446 as if only one slot machine 2 is being accessed. It is to be understood that a step which is described with reference to a particular field applies to that field for any number of slot machines 2 being accessed.

The remote wagering terminal database 448, as shown in FIG. 6, includes multiple records, each record pertaining to a different remote wagering terminal 5 as identified by a remote wagering terminal ID number as stored in the remote wagering terminal ID field 4480. The additional fields in each record include: terminal location 4481, player ID 4482, start time of remote play 4483, end time of remote play 4484, and slot machine type 4485. It is to be understood that the system 1 may, for example, use the information stored in the remote wagering terminal database 448 to determine which terminals 5 are used most often, when each terminal is in use, and the location of the remote wagering terminals 5 being used. Because the remote wagering terminal database 448, like the session database 446 and the player database 444, contains a player ID field 4482, the system 1 can correlate information contained within the above three databases 444, 446, 448 for a particular player, as identified by the player ID.

Figure 7:
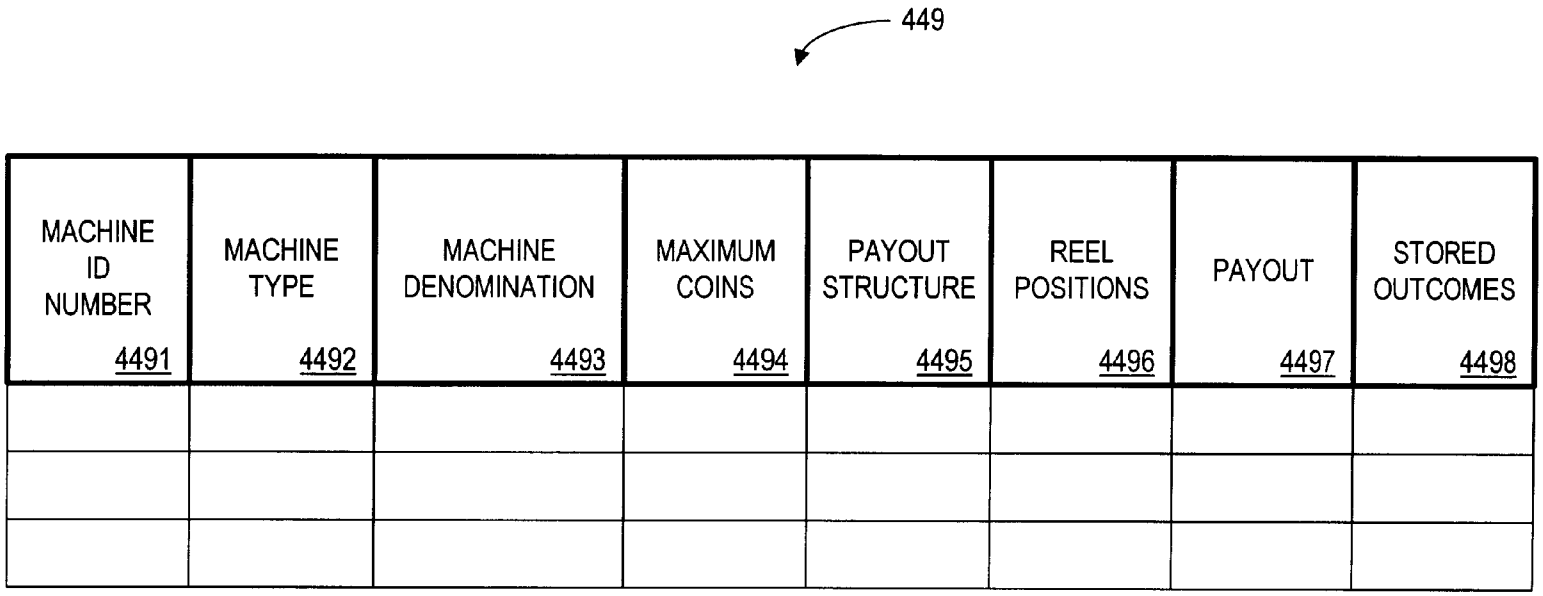
FIG. 7 is a schematic view of the slot machine database of the slot network server of FIGS. 1 and 3.

The slot machine database 449 relates to information concerning particular slot machines 2. As illustrated in FIG. 7, each slot machine 2 has an associated record in the. database identified by a machine ID number, as stored in the machine ID number field 4491. The other fields in the slot machine database 449 include: machine type 4492, machine denomination 4493, maximum coins allowed 4494, pay out structure 4495, outcome data, and in this embodiment, reel position 4496 and payout 4497, and historical outcome data 4498. Because the slot network server 4 may search any field in a slot machine database 449, the server 4 is able to identify a slot machine 2 not only by its machine ID number 4491, but also by the type 4492 and denomination 4493 of a slot machine 2.

The payout structure 4495 of the slot machine database 449 relates payout information, to machine outcome. Specifically, the payout structure 4495 correlates a given payout, such as ten coins, to a reel outcome that results in that payout, such as "cherry-cherry-bar."

Figure 8:
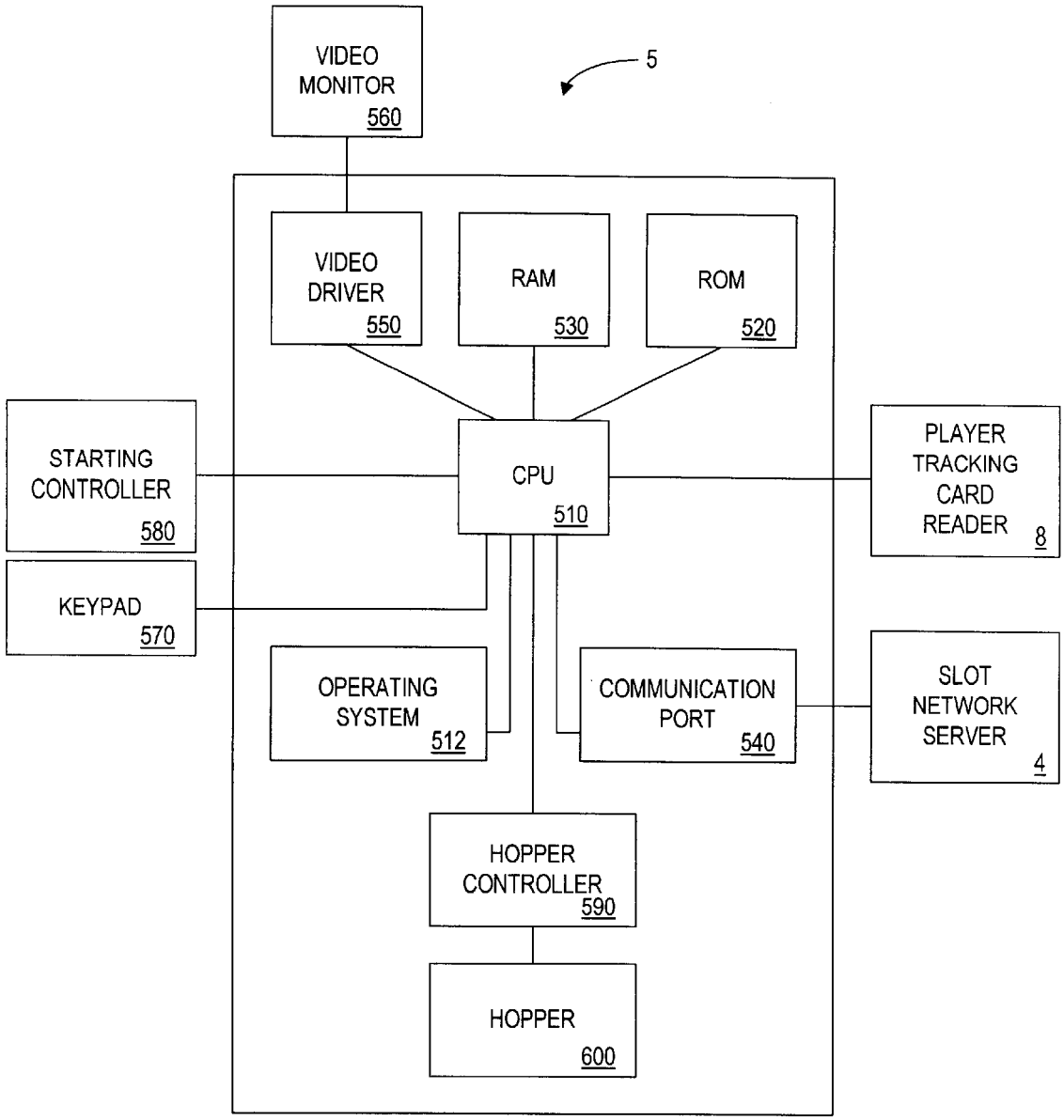
FIG. 8 is a schematic view of a remote wagering terminal of FIG. 1.

The remote wagering terminal 5 will now be described in greater detail with reference to FIG. 8. The remote wagering terminal 5 includes an operating system 512 and a Central Processing Unit (CPU) 510 that executes instructions from a program stored in Read Only Memory (ROM) 520. During such execution, the CPU 510 temporarily stores and retrieves information from the Random Access Memory (RAM) 530.

The CPU 510 can access information from several sources. For example, the CPU 510 accesses the slot network server 4 via a communication port 540. Additionally, as described in greater detail below, the remote wagering terminal 5 may read player identifying information from a player tracking card, which has been inserted into the player tracking card reader 8, and then communicate that information, via the communication port 540, to the slot network server 4. Similarly, the slot network server 4 may transmit information to the CPU 510.

Additionally, the CPU 510 is coupled to a video driver 550. The video driver 550, in turn, is coupled to a video monitor 560. The video driver 550, as directed by the CPU 510, displays outcome data of one or more slot machines 2 that has been received from a slot network server 4.

Also connected to the CPU 510 is a keypad 570. The keypad 570 may be used by a player to input any alphanumeric information, such as play preferences, as required. The information entered by the player via the keypad 570 is available to the remote wagering terminal 5, as well as the slot network server 4 and the individual slot machines 2.

Like each slot machine 2, each remote wagering terminal 5 has a starting controller 580, a hopper controller 590, and a hopper 600. As with each slot machine 2, these components are coupled to the CPU 510. The starting controller 580 is used to initiate play at the remote wagering terminal 5. The hopper controller 590 controls the hopper 600 as in the slot machine 2, to make a payout. In an alternate embodiment, the remote wagering terminal 5 does not make a payout, but rather directs the slot network server 4 to increment the credit balance 4446 by the amount of the payout.

Figure 9:
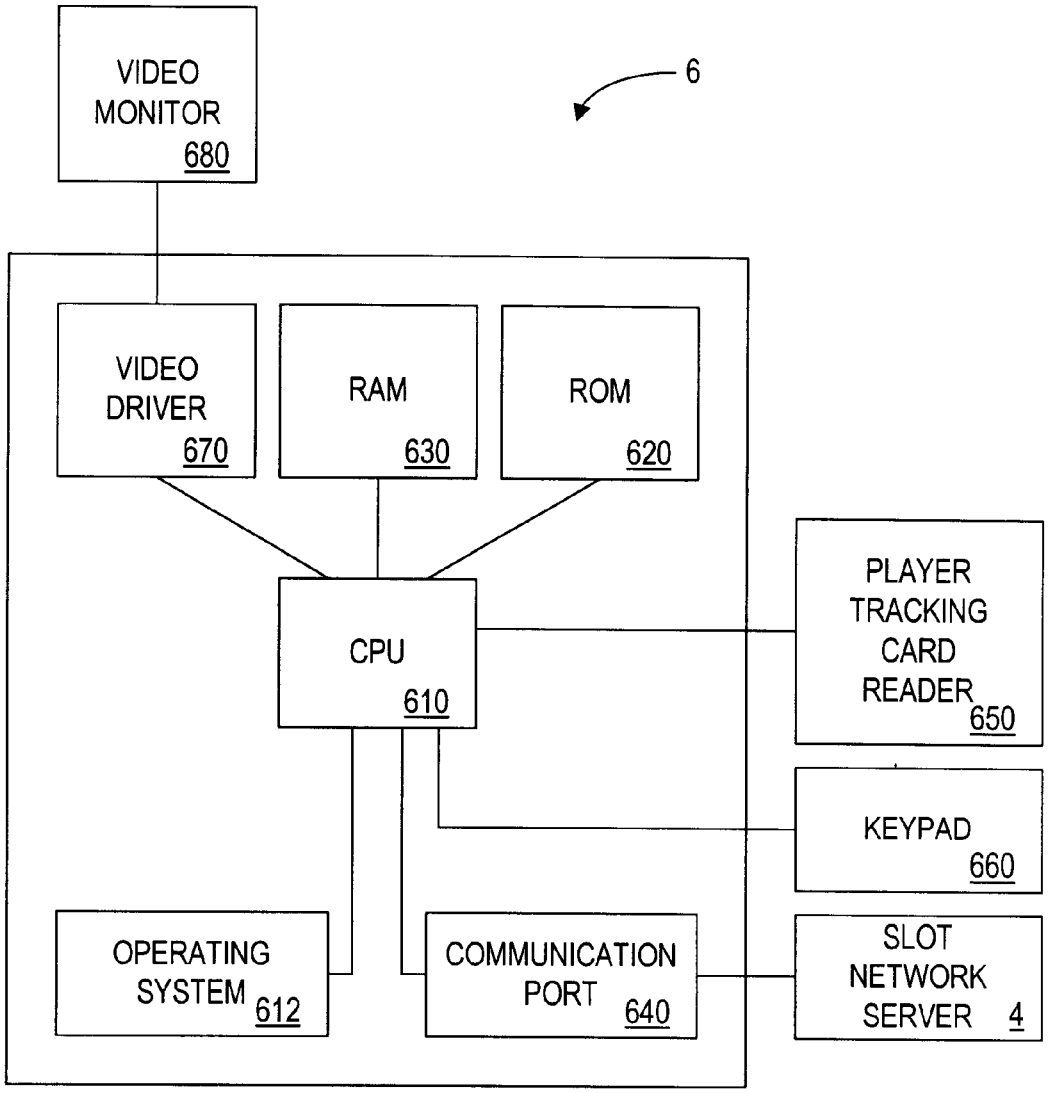
FIG. 9 is a schematic view of the cashier terminal of FIG. 1.

The cashier terminal 6 will now be described in greater detail with reference to FIG. 9. The cashier terminal 6 includes a Central Processing Unit (CPU) 610, which executes instructions of a program stored in Read Only Memory (ROM) 620. The CPU 610 has associated therewith an operating system 612 stored in memory. During execution of the instructions stored in ROM 620, the CPU 610 temporarily stores information in a Random Access Memory (RAM) 630.

A communication port 640 is interposed between the CPU 610 and the slot network server 4. Therefore, the CPU 610 can transmit information to the slot network server 4, and the slot network server 4 can transmit information to the CPU 610.

As with the remote wagering terminal 5, the cashier terminal 6 includes a player tracking card reader 650 connected to the CPU 610. The player tracking card reader 650 reads the player identifying information from a player tracking card 9 that has been inserted therein. The CPU 610, by controlling a video driver 670, may display the player identifying information on a video monitor 680.

Additionally, the cashier terminal 6 includes a keypad 660 connected to the CPU 610. Casino personnel, as described below, use the keypad 660 to input data. The cashier terminal 6 transmits this data via the communication port 640 to the slot network server 4 for use by the slot network server 4 in updating the databases contained therein.

Figure 10:
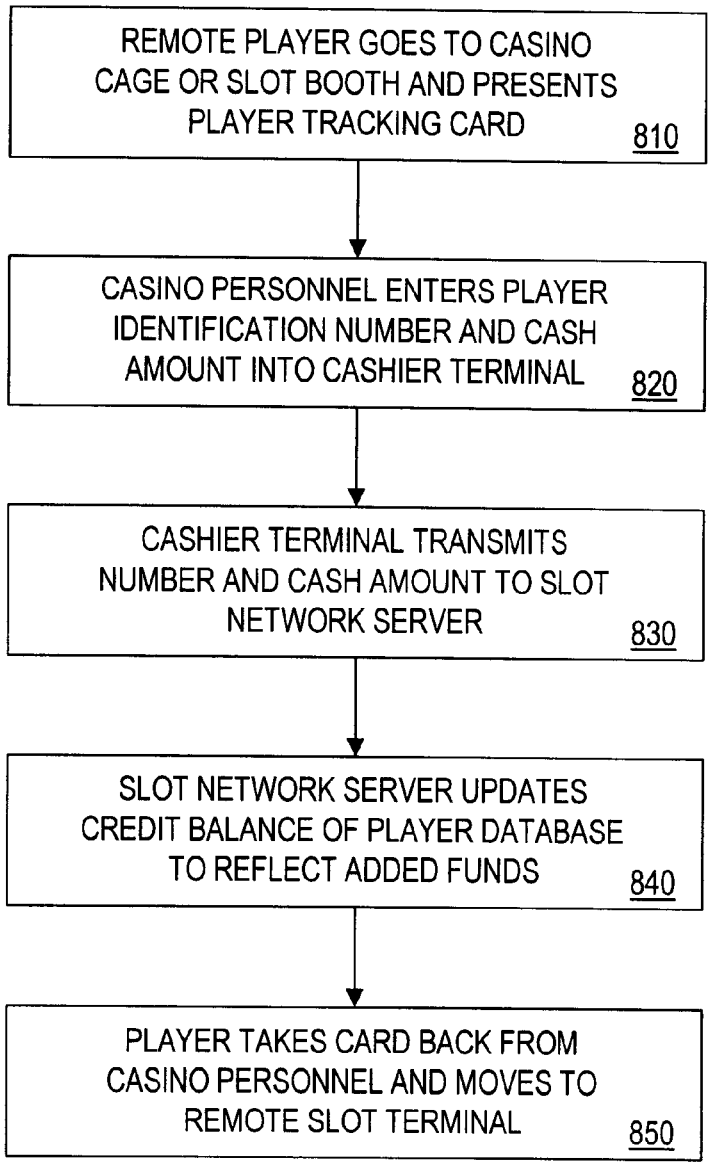
FIG. 10 is a flow diagram depicting the depositing of funds for use in accordance with the system of FIG. 1.

Having thus described the components of the present embodiment, the general operation of the system 1 will now be described with reference to FIG. 10, and continuing reference to FIGS. 1–9.

As an initial step in the operation of the present embodiment, the remote player adds finds to the credit balance 4446. Shown as step 810, the player adds funds by producing the player tracking card and depositing a certain amount of funds at the cashier terminal 6. Casino personnel enter the player's tracking card into the card reader 650 to read the player's ID number for display on the video monitor 680. In step 820, the personnel enter the player's ID number and the amount of funds deposited using the keypad 660. The cashier terminal 6 transmits the player ID number and the amount of funds deposited to the slot network server 4 in step 830.

The server 4 then accesses the record in the player database 444 containing the received player ID number. The server 4, in step 840, proceeds to increment the credit balance 4446 in the particular player's record by the amount of funds deposited. In short, the remote player has converted cash into a credit balance for use at a remote wagering terminal 5. When the transaction is completed, as shown in step 850, the casino personnel return the player tracking card, and the player is ready to initiate remote play.

As will now be described with reference to FIG. 11, once the player has added finds to the credit balance 4446, the player proceeds to a remote wagering terminal 5 to initiate remote play. In step 910, the remote player enters the player tracking card into a player tracking card reader 8 associated with a particular remote wagering terminal 5. The player tracking card reader 8 reads the player identifying information on the player tracking card and communicates that information to the CPU 510. The CPU 510, in turn, transmits the player identifying information, via the communication port 540, to the slot network server 4. Upon receiving the identifying information, the slot network server 4 authenticates the player ID.

Authenticating the player ID, as shown as step 920, involves the slot network server 4 receiving the player ID via the communication port 450 and searching the player database 444 for the record having the received player ID number in the player ID number field 4442. If no record exists in the player database 444 having the particular player ID number, then the remote player is rejected, and remote play is not allowed. On the other hand, if the transaction processor 442 identifies a record in the player database 444 containing the player ID number, and the player name, then the remote player is accepted for remote play. In an alternate embodiment, additional identifying information may be checked, such as social security number, telephone number, address, and the like.

Once the slot network server 4 authenticates the player name and the player ID, the remote player proceeds to enter play preferences. Preferably, as shown as step 930, the remote wagering terminal 5 generates a prompting message on the video monitor 560, requesting that the remote player enter the play preferences. Specifically, the slot network server 4 transmits a signal to the remote wagering terminal 5, initiating the prompting of the message. In response to the prompt on the video monitor 560, the remote player proceeds to enter play preferences via the touch screen of the video monitor 560. Alternatively, the player uses the keypad 570. Entering the play preferences is shown as step 940. The remote wagering terminal 5 accepts the entered play preferences and transmits them to the slot network server 4.

Upon receiving the play preferences, the slot network server 4 stores them in the session database 446, as shown as step 950. The particular record in the session database 446 in which the play preferences are stored is defined by the remote wagering terminal ID in field 4460 and the remote player's ID in the player ID number field 4461. In the present embodiment, the play preferences include: the number of slot machines to be accessed 4462, the slot machine type 4463, the slot machine denomination 4465, and the slot machine ID number 4469 of a particular slot machine 2.

A player is able to enter the machine ID number 4469 of a particular slot machine 2 because each slot machine 2 prominently displays an ID tag containing the ID number for that slot machine 2. It is also anticipated that the casino will provide a map of all slot machines 2, each machine being identified by its machine ID number. In practice, a player will identify a machine 2 that is in the player's opinion, "due to hit," enter that machine's ID number as a play preference, and remotely wager on the play of that slot machine 2.

The play preferences also include play options, such as the bet per pull 4464. Storing the play preferences in the session database 446 is shown as step 950. In addition to the play preferences, the remote wagering terminal 5 transmits its terminal ID number to the slot network server 4 for inclusion in field 4460 of the player's record in the session database 446.

With regard to steps 930–950, the player preferably enters the "number of machines to be accessed" 4462 first. The system 1 repeats steps 930–950 as many times as the number of machines to be accessed 4462. Thus, a set of play preferences for each slot machine 2 to be accessed is stored in the session database 446. Furthermore it is to be understood that a player need not enter a play preference for each corresponding field in the session database 446.

For example, a player may decide to remotely wager on two slot machines—a particular slot machine 2 and a slot machine 2 of a particular type and denomination. Specifically, the player first enters "two (2)" as the number of machines to be accessed 4462. The player proceeds to enter the first set of play preferences associated with the first machine 2 to be played, namely the machine ID number 4469, as read from the ID tag or slot machine map and the bet per pull 4464.

The player then enters the second set of play preferences associated with the second slot machine 2 to be played. Specifically, the player enters the slot machine type 4463 to be wagered on, such as a "pinball" slot machine, the slot machines denomination 4465, such as a "dollar" slot machine, and the bet per handle pull 4464, such as three coins or dollars.

Having received the play preferences, the slot network server 4 as shown in step 960, accesses the record in the remote wagering terminal database 448 identified by the remote wagering terminal ID 4480. The server 4, proceeds to enter the player ID number into the appropriate field 4482 of the record.

Having created the record in the remote wagering terminal database 448, the slot network server 4 searches the slot machine database 449 for a slot machine 2 defined by a set of play preferences previously stored in the session database 446. Thus, in step 970, the slot network server 4 selects any number of slot machines 2 as identified by the number of machines to be accessed field 4462. Preferably, the server 4 selects slot machines 2 that are currently being played by players physically present at the slot machines 2 so as to use live outcome data.

As shown as step 980, the slot network server 4 receives live outcome data from the selected slot machines 2. Where the live outcome data includes the outcome, i.e. reel positions, the reel positions may be received by the server 4 one at a time or all three at once. Furthermore, so that the server 4 can identify which of the received outcome data corresponds to which slot machine 2, the slot machine 2 transmits the outcome data along with its machine ID number. In alternate embodiments, other machine identifying information may be transmitted with the outcome data.

In step 990, the slot network server 4 proceeds to transmit the live outcome data for those selected slot machines 2 to the remote wagering terminal 5 identified by the remote wagering terminal ID number stored in the record of the session database 446 for that remote player. In the present embodiment, the remote wagering terminal 5 displays the outcome, such as the reel positions (or card values for video poker machines) (as stored in field 4467), as well as the payout information (as stored in field 4468), if any. Moreover, the remote wagering terminal 5 may display the reel positions one at a time, or all at once. Furthermore, the remote wagering terminal 5 simulates play of the selected slot machine 2 based upon the received live outcome by generating a graphical display of spinning reels in the same manner as a conventional slot machine 2. In alternate embodiments employing gaming devices other than slot machines 2, the remote wagering terminal 5 similarly simulates play, such as the graphical dealing of cards or spinning of a roulette wheel.

In step 1000, the slot network server 4 updates the remote player's credit balance field 4466, which is also displayed. After the server 4 updates the player's credit balance field 4466, the server 4, in step 1010, determines whether the player has enough funds remaining to allow continued play. If enough funds remain, the remote play repeats from step 970.

Figure 12:
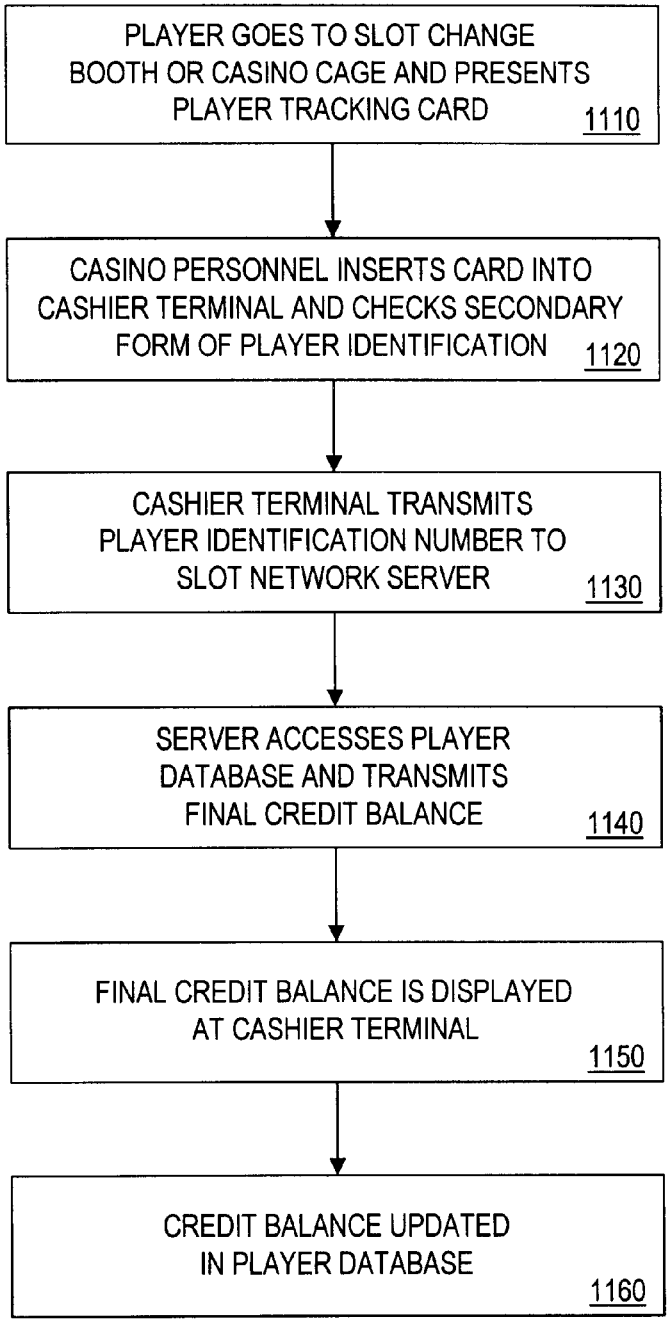
FIG. 12 is a flow diagram depicting the process of receiving a payout in accordance with the system of FIG. 1.

If insufficient funds remain in the credit balance 466, the server 4 directs the remote wagering terminal 5 to display a message indicating a lack of funds. In response, the player may discontinue remote play (step 1020) or the player may deposit additional funds for continued play. To continue remote play, the player deposits finds as described with reference to FIG. 10, or the player deposits funds directly into the remote wagering terminal 5 as described above. The steps for cashing out when remote play is completed will now be described with reference to FIG. 12. In step 1110, the player takes the player tracking card and goes to the change booth or casino cage and presents the player tracking card to casino personnel. In step 1120, the casino personnel inserts the player card into the card reader 650 of the cashier terminal 6. By having the player's name, which is stored on the card, displayed on the video monitor 680, the personnel is able to check a secondary form of player identification, such as a drivers license. Thus, an imposter would be prevented from receiving disbursements.

Once the secondary form of identification has been checked, the cashier terminal 10 transmits the player ID number to the slot network server 4. This step is illustrated as 1130. As shown in step 1140, the slot network server 4 receives the player ID and player name and proceeds to access the record in the player database 444 corresponding to that player ID number and player name. The slot network server 4 proceeds to transmit the value stored in the credit balance field 4446 to the cashier terminal 6.

Once the cashier terminal 6 receives the credit balance, the cashier terminal 6 displays it to the personnel in step 1150. Thus, having been informed of the credit balance for the particular player, the casino personnel proceed to disburse any amount of cash up to the amount of the credit balance. Whatever amount is disbursed is then entered into the cashier terminal 6 via keypad 670 and transmitted to the slot network server 4. The slot network server 4, in turn, updates the credit balance field 4446 by the amount disbursed.

Alternatively, the player may choose to cash out at the remote wagering terminal 5, thereby receiving coins. In such an embodiment, the remote wagering terminal 5 includes a hopper controller and a payment tray (not shown) for dispensing coins. A record of the amount of coins stored in the remote wagering terminal 5 determines whether the remote wagering terminal 5 has enough coins to permit a coin payout.

Figure 11A:
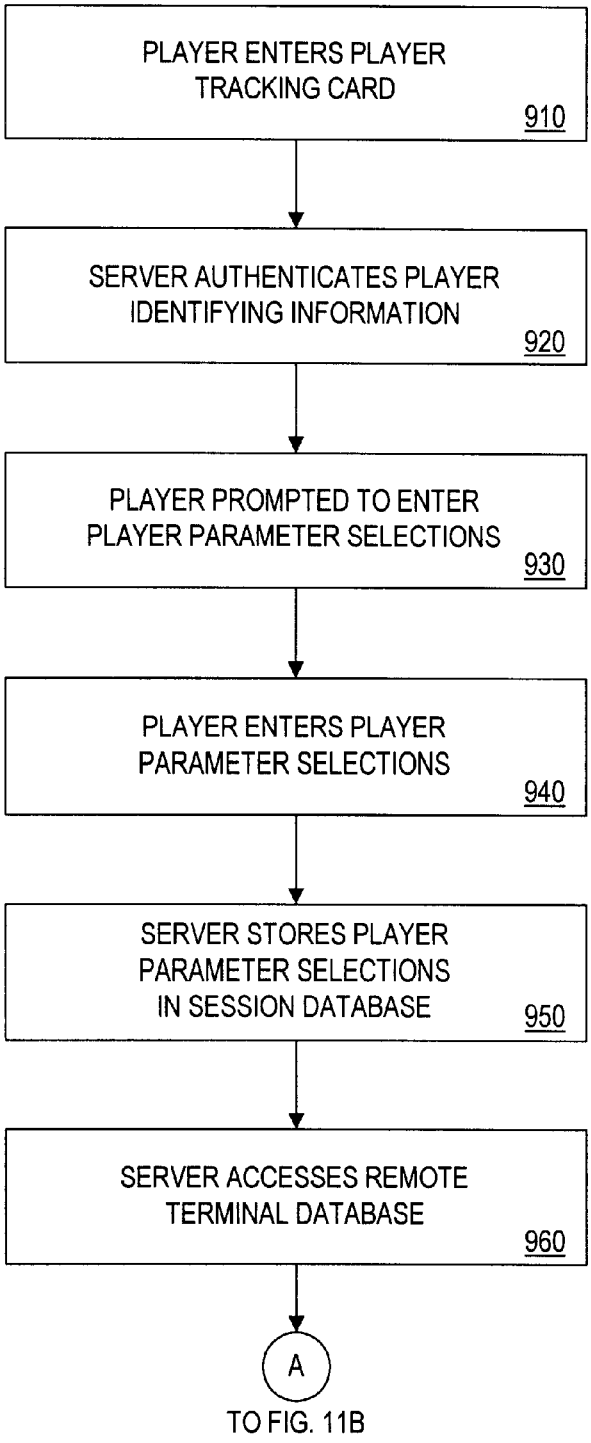
FIGS. 11*a* and 11*b* are flow diagrams of the overall operation of the system of FIG. 1.
Figure 11B:
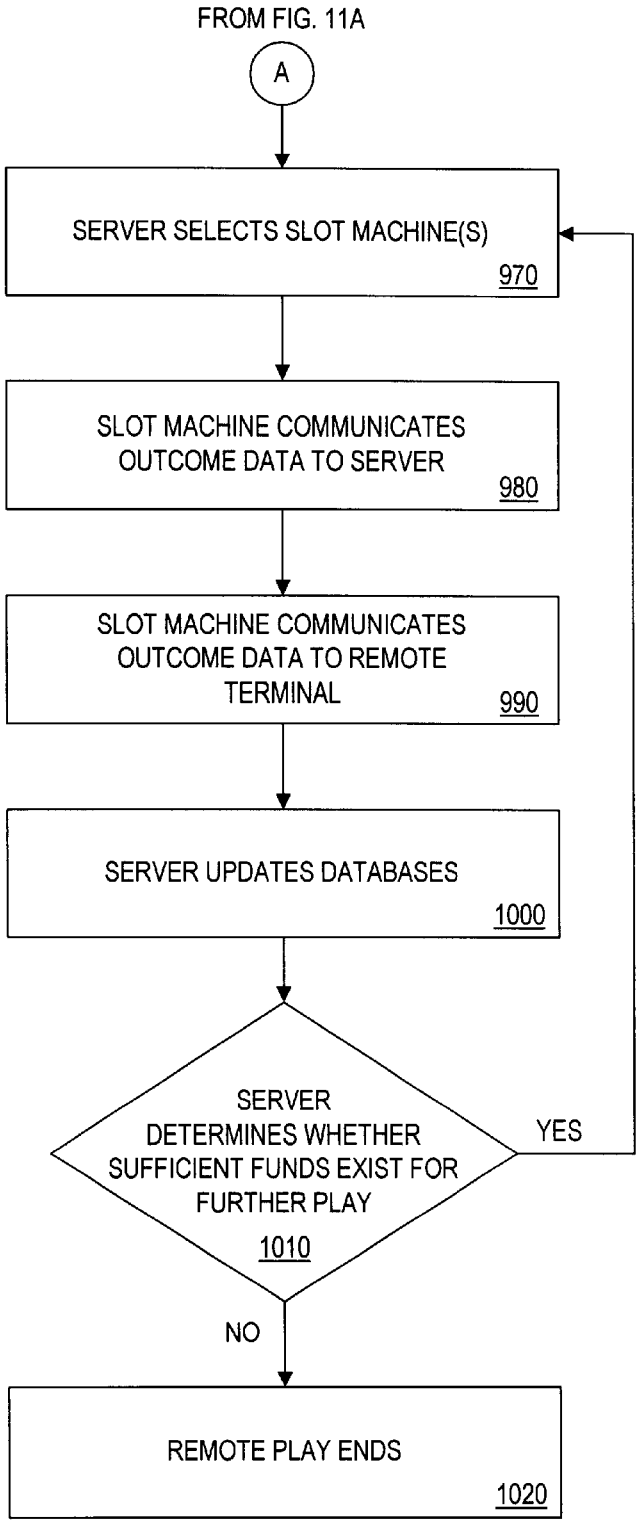

In an alternate embodiment, the outcome data transferred in step 980 of FIG. 11 need only include the payout 4497, if any. In such an alternative embodiment, the slot machine 2 communicates only the payout information to the slot network server 4. The slot network server 4, as an alternative to step 990 of FIG. 11, simulates an outcome representative of that payout information.

The server 4 simulates an outcome by accessing the slot machine database 449 and, based upon the machine ID number transmitted with the payout 4497, the record for that slot machine 2. A payout structure for that particular slot machine 2 is maintained within the record in field 4495. The payout structure, like the payout table 284 in the slot machine 2, correlates the payout received from slot machine 2 to a possible reel result.

For example, when the reels 262, 264, 266 of the slot machine 2 reveal "cherry-cherry-bar," the slot machine 2 may have determined that, according to the payout table 284, the player should receive a payout of ten coins. The slot machine 2 then communicates to the slot server 4 a payout of ten coins. The server 4, by accessing the payout structure, correlates the payout of ten coins back into the reel positions of "cherry-cherry-bar." Because several reel positions may correspond to the same payout, the slot network server 4 may determine that the reel positions are different than the outcome "cherry-cherry-bar" that occurred on the slot machine 2. Thus, the server 4 generates a simulated outcome of the slot machine 2 for transmission to the remote wagering terminal 5.

In an alternate embodiment, no live outcome data is received from a slot machine 2 in step 480. Instead, the slot network server 4 selects historical outcome data previously stored in field 4498 of the slot machine database 449. As when live outcome data is used, the server 4 selects the historical outcome data 4498 based upon the play preferences.

As will be apparent to one skilled in the art, use of historical outcome data 4498 is particularly advantageous to owners of slot machines 2. Each piece of outcome data received by the server 4 has inherent value. This value stems, at least in part, from the resources required to generate the outcome data, capital investment in each slot machine 2, electricity to operate the slot machine 2, and wear on the slot machine 2 from each play. Thus, by storing the outcome data in the historical outcome data field 4498, the system 1 is able to reuse outcome data and, in a sense, recycle it.

In alternate embodiments, the historical outcome data 4498 includes the historical outcome of at least one play of a gaming device, the historical payout of at least one play of a gaming device, or both the historical outcome and historical payout. Where the historical outcome data 4498 includes both historical outcome and historical payout information, the slot network server 4 merely retrieves the historical outcome data 4498 and the system 1 proceeds from step 990, as described above, based upon this information. Where the historical outcome data 4498 is just historical outcome, the server 4 determines the historical payout information by accessing the payout structure 4495. The server 4 then proceeds from step 990.

Where the historical outcome data 4498 includes only historical payout information, the server 4 must first simulate the corresponding historical outcome. As with simulating a live outcome, the server 4 simulates the historical outcome by accessing the payout structure 4495 and, based upon the known historical payout, determining the simulated historical outcome. The system 1 proceeds from step 990, as described above, based upon the historical payout and the simulated historical outcome.

It is to be understood that the player tracking card is not essential to the present invention. For example, in an alternative embodiment, the player enters player identifying information via the keypad 570. Moreover, another embodiment requires no player identifying information. Instead of using player identifying information to identify a credit balance, the player merely enters coins into the remote wagering terminal 5. The remote wagering terminal 5, like a conventional slot machine, stores the amount of credit. With each play, the remote wagering terminal 5 deducts the appropriate bet per play.

Although the present invention has been described in terms of certain preferred embodiments, other embodiments that are apparent to those of ordinary skill in the art are also intended to be within the scope of the present invention. Accordingly, the scope of the present invention is intended to be limited only by the claim appended hereto.

What is claimed is:

1. A server comprising:

means for receiving live outcome data from a gaming device wherein a paid play initiates a random event that results in said live outcome data;

means for storing said live outcome data received from said gaming device as historical outcome data; and means for reusing said historical outcome data to generate an outcome for a game.

2. The server of claim 1 wherein said gaming device comprises a slot machine.

3. The server of claim 1 wherein said game includes a paid play.

* * * * *